United States Patent [19]

Worthington, Jr.

[11] Patent Number: 5,000,210

[45] Date of Patent: Mar. 19, 1991

[54] SUN SHADE

[76] Inventor: Thomas D. Worthington, Jr., 3282 Chatham Rd., Atlanta, Ga. 30305

[21] Appl. No.: 484,515

[22] Filed: Feb. 23, 1990

[51] Int. Cl.[5] ..... E04H 15/04

[52] U.S. Cl. ..... 135/90; 135/96; 248/231.8; 297/184

[58] Field of Search ..... 135/87, 90, 98, DIG. 9, 135/109, 96; 297/184; 248/230, 231.8

[56] References Cited

U.S. PATENT DOCUMENTS

| | | | |
|---|---|---|---|
| 2,772,684 | 1/1953 | Puls et al. . | |
| 2,812,208 | 11/1957 | Francis | 135/90 X |
| 3,050,280 | 8/1962 | Regan . | |
| 3,162,206 | 12/1964 | Betts | 135/90 |
| 3,243,230 | 3/1966 | Otto . | |
| 3,738,703 | 6/1973 | Kunimatu | 297/184 |
| 3,975,068 | 8/1976 | Speckin | 248/230 X |
| 4,093,305 | 6/1978 | Staroste et al. | 297/184 |
| 4,201,416 | 5/1980 | Vanderminden | 297/184 |
| 4,230,363 | 10/1980 | Borichevsky | 297/184 |
| 4,295,481 | 10/1981 | Gee | 135/5 R |
| 4,300,798 | 11/1981 | Musgrove et al. | 297/184 |
| 4,635,667 | 1/1987 | Harn | 297/184 X |
| 4,781,411 | 11/1988 | Kolb | 297/184 |

FOREIGN PATENT DOCUMENTS

| | | | |
|---|---|---|---|
| 93591 | 6/1962 | Denmark | 297/184 |
| 2921891 | 12/1980 | Fed. Rep. of Germany | 248/231.8 |

*Primary Examiner*—David A. Scherbel
*Assistant Examiner*—Lan Mai
*Attorney, Agent, or Firm*—Thomas & Kerr

[57] ABSTRACT

A sun shade (10) for mounting to a chair or other furniture comprises a support frame (11) including a lateral tube (21) and vertical tubular legs (12, 13) pivotally mounted to the lateral tube. A central clamp (26) is rigidly mounted to the lateral tube (21) and includes a U-shaped opening (36) for engagement over an upper edge portion of the chair. Outboard clamps (41, 42) are slidably positioned on lateral tube (21) and have U-shaped openings (43, 44) for engagement over side edge portions of the chair. Means (22, 23, 24) are provided for resisting the pivotal movement of the tubular legs (12, 13) relative to the lateral tube (21). A canopy assembly (51) is pivotally mounted to the tubular legs (12, 13) and includes a rectangular frame (52) and a fabric panel (56).

12 Claims, 1 Drawing Sheet

SUN SHADE

TECHNICAL FIELD

The present invention relates to protective devices, and more particularly to a sun shade for mounting to an outdoor chair or the like.

BACKGROUND OF THE INVENTION

In the use of outdoor furniture, it is often desirable to shield oneself from the direct rays of the sun and it is known in the art to mount a shade or canopy to a chair to provide protection from the sun's rays. For example, Regan U.S. Pat. No. 3,050,280 discloses an umbrella mounted to an upper edge portion of a folding chair for providing shade. Otto U.S. Pat. No. 3,243,230 discloses a sun shade for mounting to a folding chair comprising a support frame pivotally mounted to the folding chair and a shade pivotally mounted to the support frame.

Such known shades or umbrellas can be cumbersome or time-consuming to mount to a chair and often can damage the chair to which they are mounted. Furthermore, such shades often require that the chair be modified for mounting and are ill-suited for mounting to chairs of different widths and configurations. Thus, a need remains for a sun shade which can be mounted to a chair quickly and easily without modifying or damaging the chair and which is well suited for mounting to chairs of different widths and configurations. It is to the provision of such a sun shade that the present invention is primarily directed.

SUMMARY OF THE INVENTION

In a preferred form, the present invention comprises a sun shade for mounting to a chair or other furniture and includes a support frame having generally lateral and upright portions pivotally mounted to each other. A first clamp having a generally U-shaped opening is affixed to the lateral portion of the support frame for engagement of the U-shaped opening over an upper edge portion of the chair. Second and third outboard clamps having generally U-shaped openings perpendicular to the opening in the first clamp are slidably mounted to the lateral portion of the support frame for engagement of the U-shaped openings over side edge portions of the chair. A cover is pivotally mounted to the vertical portion of the support frame at an end distal from the lateral portion of the support frame. Means are included for providing resistance to pivotal movement of the upright portion of the support frame relative to the lateral portion of the support frame.

So constructed, the U-shaped portion of the first clamp can be slipped over the upper edge portion of the chair and the outboard clamps can be slid toward the chair so that the U-shaped portions of the outboard clamps slip over the side edge portions of the chair to fasten the support frame to the chair with both lateral and vertical stability. In this manner, the sun shade can be mounted to chairs of different widths and configurations quickly and easily, without modifying or damaging the chair.

Other features and advantages of the present invention will become apparent upon reading the following specification in conjunction with the accompanying drawing figures.

BRIEF DESCRIPTION OF THE DRAWING FIGURES

DETAILED DESCRIPTION

Figure 1:
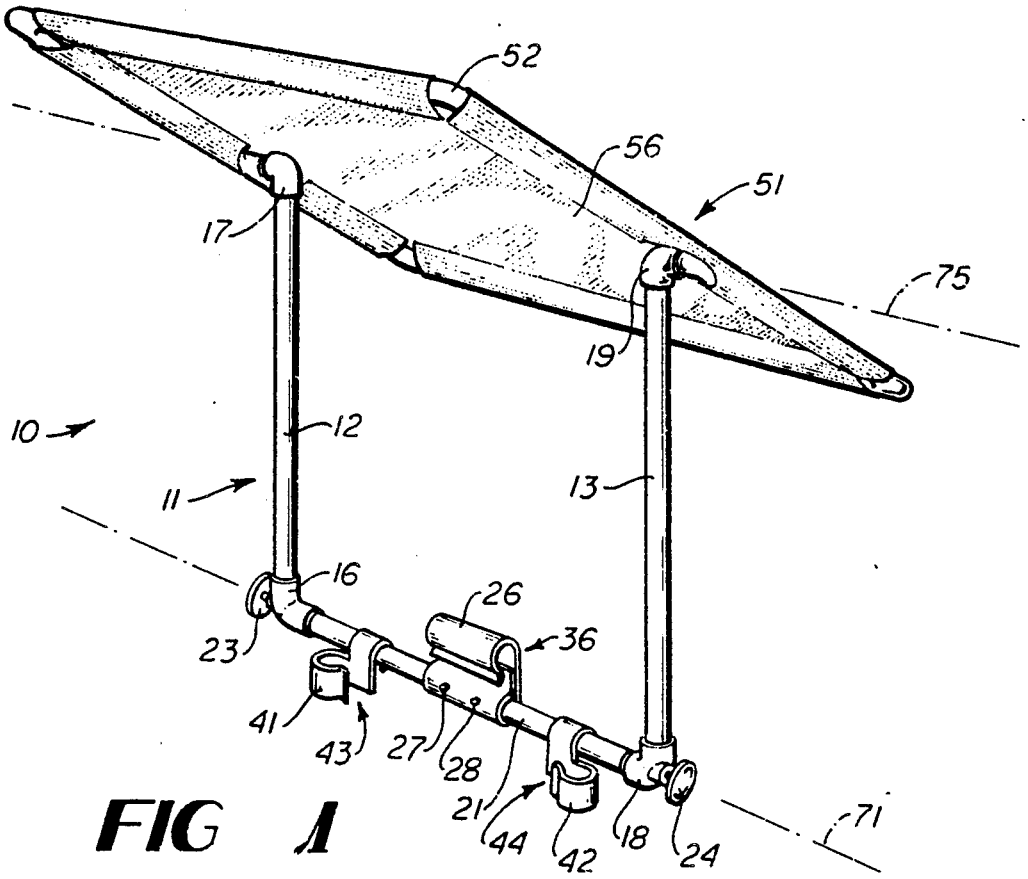
FIG. 1 is a perspective illustration of a sun shade in a preferred form of the invention.

Referring now in detail to the drawing figures, in which like reference numerals represent like parts throughout the several views, FIG. 1 shows a sun shade assembly 10 in a preferred form of the present invention. Sun shade 10 includes a support frame 11 which is made up of a pair of elongated tubular legs 12 and 13. An L-shaped elbow 16 is rigidly mounted to the lower end of the leg 12 and a second L-shaped elbow 17 is rigidly mounted to the leg at the opposite end. Likewise, leg 13 terminates in elbows 18 and 19, with the elbows 16 and 18 pointing toward each other and the elbows 17 and 19 pointing away from each other. Support frame 11 further comprises a lateral tube or connector bar 21 which extends between the legs 12 and 13 and is pivotally received within the elbows 16 and 17. The length of lateral tube 21 preferably is chosen to space the legs 12 and 13 apart from each other a distance sufficient to allow the legs to clear the seat back of most chairs as the legs pivot.

The legs, the lateral tube and the elbows are preferably made of a light-weight material, such as thin-wall metal tubing or plastic pipe, and in the preferred embodiment are made of PVC tubing. In this embodiment where two elements are rigidly joined together, the elements typically are joined by using suitable cement as is well known in the art.

Figure 2:
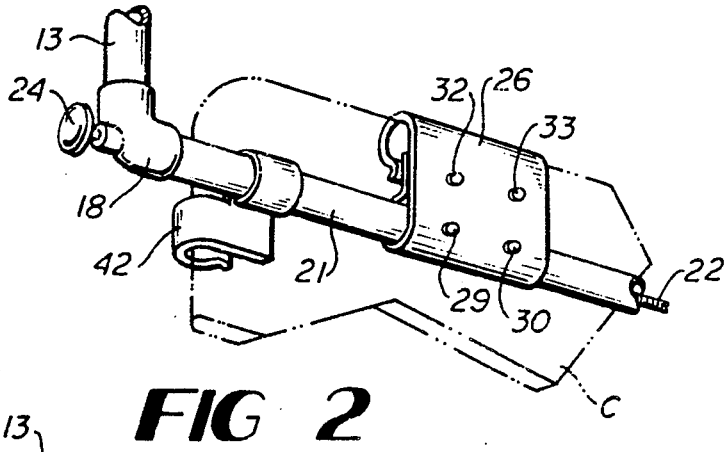
FIG. 2 is a perspective illustration of a portion of the sun shade of FIG. 1, showing the sun shade mounted to a portion of a chair.
Figure 5:
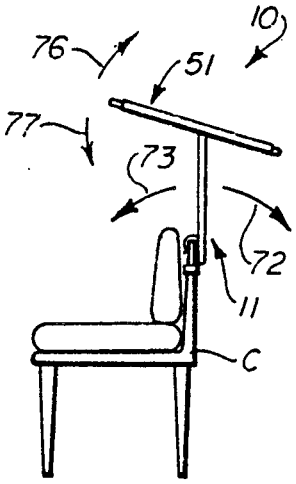
FIG. 5 is a side elevation view of the sun shade of FIG. 1, showing the sun shade mounted to a chair.

As best seen in FIGS. 1 and 2, a threaded tensioning rod 22 extends through the lateral tube 21 and through the elbows 16 and 18. Knobs 23 and 24 are threadedly mounted on the tensioning rod 22 externally of elbows 16 and 18 and are adapted to bear against the elbows. Thus, when knobs 23 and 24 are tightened sufficiently against the elbows 16 and 18, a compressive force is applied to elbows 16 and 18 and lateral tube 21 to resist pivotal movement of the legs and elbows relative to the lateral tube.

Figure 3:
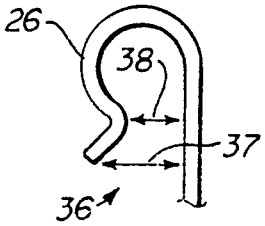
FIG. 3 is a side elevational view of a portion of the sun shade of FIG. 1.

A clamp 26 is positioned centrally along lateral tube 21 and is rigidly mounted thereto by means of rivets 27, 28, 29 and 30. Central clamp 26 is made from a length of flat UV-stabilized polycarbonate stock, with one end being folded over to lie flat against the middle portion to form a closed loop for receiving lateral tube 21. This first end of the previously flat stock is held fast against the flat middle portion of the stock by rivets 32 and 33. The opposite end of the flat stock is bent to form a generally U-shaped opening 36, as best seen in FIG. 3. The U-shaped opening 36 includes a flared mouth indicated at 37 and a reduced dimension throat indicated at 38.

A pair of outboard clamps 41 and 42 are slidably and pivotally mounted on lateral tube 21 on opposite sides of central clamp 26. Clamps 41 and 42 are mirror images of one another and each clamp is made from an L-shaped piece of flat PVC or polycarbonate stock, with one leg of the L bent over in one direction to form an opening for receiving the lateral tube 21 and the other leg bent in an opposite direction to form an opening for receiving a side edge portion of a chair. The side edge receiving openings 43 and 44 are of substantially identical construction to that of opening 36 of central clamp 26, as depicted in FIG. 3. The outboard clamps 41 and 42 are mounted on lateral tube 21 in a manner so that the U-shaped openings 43 and 44 are perpendicular to opening 36 of clamp 26. As shown in FIG. 1, the clamps 26, 41 and 42 are arranged so that the openings of the clamps which engage the top and side edges of the chair lie on opposite sides of the lateral tube 21; i.e. the openings in clamps 41 and 42 lie below the lateral tube 21 and the opening in the clamp 26 lies above the lateral tube 21. This vertical spacing of the openings provide for a more stable mounting arrangement when the sun shade is mounted to a seat back of a chair.

A canopy assembly 51 is pivotally mounted to upper ends of the tubular legs 12 and 13 at elbows 17 and 19 distal from lateral tube 21. The canopy assembly 51 comprises a rectangular frame 52 consisting of lengths of PVC tubing connected to one another at their ends by elbows. The rectangular frame is pivotally connected at a middle portion thereof to elbows 17 and 19 by means of male threads of the elbows engaging female threads of the rectangular frame. By tightening this threaded connection, a modicum of resistance to pivotal movement of the canopy is provided. Additional means for resisting pivotal movement of the canopy assembly are not generally required owing to the balanced mounting of the canopy assembly in the middle thereof to the legs. A fabric panel 56 is stretched over the rectangular frame 52 and secured thereto by stitching.

Figure 4:
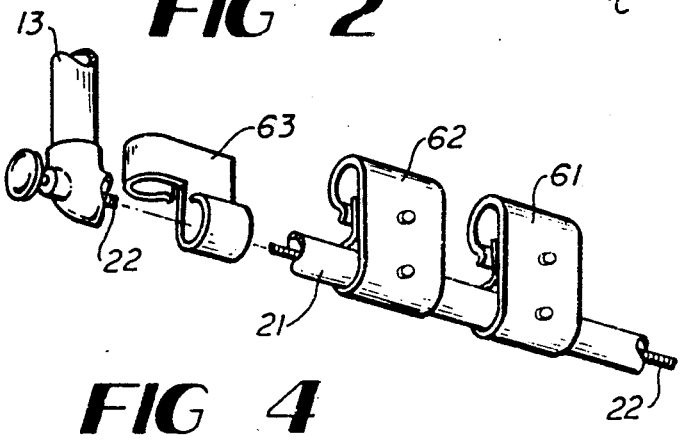
FIG. 4 is a perspective illustration of a portion of a sun shade in a second preferred form of the invention.

In a alternative embodiment as shown in FIG. 4, central clamp 26 is replaced with two narrower inner clamps 61 and 62. Outboard clamp 42 is replaced with an outboard clamp 63 which is constructed to be identical to outboard clamp 41 to minimize cost. This has the effect however of positioning the side edge receiving opening of outboard clamp 63 above the lateral tube 21, on the same side of lateral tube as the top edge receiving openings of inner clamps 61 and 62, and tends to reduce the stability of the mounting to the chair somewhat.

OPERATION

The sun shade assembly 10 can be mounted to a chair C as follows. One first slides the outboard clamps 41 and 42 away from each other along lateral tube 21 toward their adjacent elbows 16 and 18. With the outboard clamps thusly spread apart, the central clamp 26 is mounted to the chair C by slipping the U-shaped opening 36 over an upper edge portion of the chair to support the support frame upon the chair substantially vertically. The outboard clamps are then slid toward each other to slip the U-shaped openings of the outboard clamps over the side edge portions of the chair to stabilize the support frame upon the chair laterally and against any rotation. In this regard, clamps made of a somewhat flexible material and having smooth edges have been found to be most effective in avoiding damage to the chair as the clamps are slipped onto and off the chair.

With the sun shade assembly now stably mounted to the chair, the canopy assembly can be positioned as needed by pivoting the legs 12 and 13 relative to the lateral tube 21 about pivot axis 71, in the directions of arrows 72 and 73. To prevent the support frame from tipping over or from being blown over by wind, threaded knobs 23 and 24 can be tightened against elbows 16 and 18 to resist pivotal movement of the legs 12 and 13 relative to the lateral tube 21. Of course, one can also loosen the knobs to make it easier to move the legs. It may be necessary to apply some friction-reducing material, such as graphite or low-friction tape, to the joints between the elbows 16 and 18 and lateral tube 21 in order to allow the forced movement of the legs to be smooth even when the knobs are tightened somewhat to resist unintended movement. The canopy assembly can be adjustably positioned by pivoting the canopy assembly about pivot axis 75 relative to the legs 12 and 13, in the directions of arrows 75 and 76.

To remove the sun shade assembly from a chair, one slides the outboard clamps away from each other along the lateral tube to disengage the outboard clamps from the side edge portions of the chair. With the outboard clamps spread, the sun shade assembly can be lifted off the chair.

For storage, the canopy assembly can be pivoted in the direction of arrow 76 to bring the canopy assembly closely adjacent the legs to make the sun shade more compact. Alternatively, with the sun shade assembly still mounted to a chair, such as a folding chair, the legs can be pivoted in the direction of arrow 72 to bring the legs closely adjacent the chair and the canopy assembly can be pivoted in the direction of arrow 77 to bring the canopy assembly closely adjacent the legs.

While the present invention has been described in a preferred form, it will be readily apparent that many modifications, additions and deletions may be made therein, such as replacing the round tubing with square tubing, without departing from the spirit and scope of the invention as set forth in the following claims.

I claim:

1. A shading device for use with chairs and the like having a back comprising an upper edge portion and side edge portions, said device comprising a substantially U-shaped support frame having first and second legs pivotally connected to the ends of a connecting bar, a canopy, said first and second legs being pivotally connected at their distal ends to said canopy, and means for mounting said connecting bar to the chair back comprising means affixed to said connecting bar and adapted to clamp to the upper edge portion of the chair for locating and holding said device substantially upright with respect to the chair, said means for mounting further including at least one clamping member slidably mounted on said connecting bar and adapted to grasp one of the side edge portions of the back of the chair.

2. A shading device as claimed in claim 1 further comprising means for resisting pivotal movement of said legs relative to said connecting bar.

3. A shading device as claimed in claim 2 wherein said means for resisting pivotal movement comprises a threaded member positioned partly within said first and second legs for urging said first and second legs into contact with said connecting bar.

4. A shading device as claimed in claim 1 wherein said means for mounting comprises a clamp rigidly mounted to said connecting bar.

5. A shading device as claimed in claim 4 wherein said rigidly mounted clamp includes a generally U-shaped portion for engagement over the upper edge portion of the chair and wherein said slidably mounted clamping includes a generally U-shaped portion for engagement over a side edge portion of the chair.

6. A sun shade for mounting to a chair or the like comprising:

a support frame which comprises first and second portions pivotally mounted to each other;

a canopy pivotally mounted to said support frame second portion; and attachment means for mounting said support frame to a top portion of the chair and including means for mounting said support frame to a side portion of the chair, said attachment means comprising a first clamp rigidly mounted to said support frame and a second clamp slidably positioned on said support frame.

7. A sun shade as claimed in claim 6 wherein said attachment means are adapted for non-pivotally mounting said support frame first portion to the chair.

8. A sun shade as claimed in claim 6 wherein first and second clamps each include a generally U-shaped portion for engagement over top and side edge portions of the chair, respectively.

9. A sun shade as claimed in claim 8 further comprising a third clamp slidably positioned on said support frame including a U-shaped portion for engagement over a side edge portion of the chair.

10. A sun shade as claimed in claim 9 wherein said U-shaped portions of said second and third clamps are positioned to one side of said support frame and said U-shaped portion of said first clamp is positioned opposite said one side of said support frame.

11. A sun shade as claimed in claim 6 further comprising means for resisting pivotal movement of said support frame second portion relative to said support frame first portion.

12. A sun shade as claimed in claim 11 wherein said support frame second portion comprises first and second support legs pivotally mounted to opposite ends of said support frame first portion and wherein said means for resisting pivotal movement of said support frame second portion comprises threaded member means for urging said first and second support legs into engagement with said support frame first portion.

* * * * *